US008635741B2

(12) United States Patent
Peng et al.

(10) Patent No.: US 8,635,741 B2
(45) Date of Patent: Jan. 28, 2014

(54) AUXILIARY APPARATUS FOR BETTER VACUUMING EFFECT

(75) Inventors: Wen-Yang Peng, Taipei County (TW); Ya-Hui Tsai, Taoyuan County (TW); Chun-Hsien Liu, Taipei (TW)

(73) Assignee: Industrial Technology Research Institute, Hsin-Chu (TW)

( * ) Notice: Subject to any disclaimer, the term of this patent is extended or adjusted under 35 U.S.C. 154(b) by 492 days.

(21) Appl. No.: 12/915,912

(22) Filed: Oct. 29, 2010

(65) Prior Publication Data

US 2012/0047679 A1 Mar. 1, 2012

(30) Foreign Application Priority Data

Aug. 24, 2010 (TW) ..... 99128325 A

(51) Int. Cl.
*A47L 9/19* (2006.01)

(52) U.S. Cl.
USPC ..... 15/339; 15/347; 15/246.2; 15/387

(58) Field of Classification Search
USPC ..... 15/339, 347, 387, 246.2
IPC ..... A47L 9/19
See application file for complete search history.

(56) References Cited

U.S. PATENT DOCUMENTS

| | | | |
|---|---|---|---|
| 6,023,814 | A | 2/2000 | Imamura |
| 6,029,309 | A | 2/2000 | Imamura |
| 6,055,702 | A | 5/2000 | Imamura |
| 6,101,667 | A | 8/2000 | Ishikawa |
| 6,199,244 | B1 | 3/2001 | Hilgers |
| 6,618,592 | B1 | 9/2003 | Vilander et al. |
| 6,740,144 | B2 | 5/2004 | Conrad |
| 6,964,082 | B2 | 11/2005 | Hsu |
| 7,403,360 | B2 | 7/2008 | Cunningham |
| 7,562,414 | B2 | 7/2009 | Oh et al. |
| 8,147,372 | B2 | 4/2012 | Iizuka et al. |

(Continued)

FOREIGN PATENT DOCUMENTS

| | | |
|---|---|---|
| EP | 01980189 A2 | 10/2008 |
| EP | 01980190 A2 | 10/2008 |

(Continued)

OTHER PUBLICATIONS

Masaru Matsumoto, et al., Fundamental Study on the Efficiency of Flutter Power Generation System.

(Continued)

*Primary Examiner* — David Redding
(74) *Attorney, Agent, or Firm* — Morris Manning & Martin LLP; Tim Tingkang Xia, Esq.

(57) ABSTRACT

An auxiliary apparatus for better vacuum cleaning effect, comprising: a first frame, formed with a first entrance and a first exit connected to the first entrance by a channel; a second frame, formed with a second entrance and a second exit, both arranged at positions between the first entrance and the first exit while being connected to the channel; and an energy harvester, wherein an airflow entering the first frame through the first entrance is split into a first airflow and a second airflow while enabling the first airflow to flow toward the first exit and the second airflow to flow into the second frame through the second entrance where it is guided toward the energy harvester for driving the same, and then the second airflow is guided to flow out of the second exit and enters the first frame for merging with the first airflow.

20 Claims, 5 Drawing Sheets

(56) References Cited

U.S. PATENT DOCUMENTS

| | | | |
|---|---|---|---|
| 2003/0196293 | A1 | 10/2003 | Ruff |
| 2004/0035093 | A1 | 2/2004 | Conrad |
| 2008/0250764 | A1 | 10/2008 | Oh |
| 2009/0183335 | A1 | 7/2009 | Griffith |

FOREIGN PATENT DOCUMENTS

| | | | |
|---|---|---|---|
| JP | 10057287 | | 3/1998 |
| JP | 2006051171 | | 6/2006 |
| TW | 451730 | | 8/2001 |
| TW | M240387 | | 8/2004 |
| TW | M274454 | | 9/2005 |
| TW | 201011162 | A | 3/2010 |
| WO | WO2009078050 | A1 | 6/2009 |

OTHER PUBLICATIONS

Fish Technology' Draws Renewable Energy from Slow Water Currents, Science Daily.

Liaosha Tang, et al., Flutter-Mill: a New Energy-Harvesting Device, Canada.

AUXILIARY APPARATUS FOR BETTER VACUUMING EFFECT

CROSS-REFERENCE TO RELATED APPLICATIONS

This non-provisional application claims priority under 35 U.S.C. §119(a) on Patent Application No(s). 099128325 filed in Taiwan, R.O.C. on Aug. 24, 2010, the entire contents of which are hereby incorporated by reference.

TECHNICAL FIELD

The present disclosure relates to an auxiliary apparatus for better vacuuming effect, and more particularly, to an auxiliary apparatus for vacuum cleaners, that not only is featured by its configuration of an independent second frame embedded with filters and an energy harvester in a manner that the filters in the second frame can prevent the energy harvester from being contaminated and thus clogged by dirt and dust while the energy harvester is operating for converting wind energy into electricity, but also is featured with its modularized design that the auxiliary apparatus can be easily detached from a vacuum cleaner as required.

TECHNICAL BACKGROUND

Generally, common household vacuum cleaners are equipped with many interchangeable accessories to be used for cleaning a variety of environments, such as carpets, curtains, corner, slit, etc. However, in a situation when a common household vacuum cleaner is used to clean certain areas that are lack of lighting, such as the area under a bed or sofa, users usually will find that it is difficult to proceed with the cleaning work in such dark environment since the accessories of the conventional household vacuum cleaner are not fitted with light sources designed for facilitating the cleaning work in poor lighting. Thus, in addition to operate the household vacuum cleaner by one hand, the user may have to hold a flash light in another hand just for projecting light to such dark spot so as to proceed with the cleaning work.

A vacuum cleaner is a device that uses an air pump to create a partial vacuum for inducing an airflow to suck up dust and dirt from its dust inlet while enabling the included airflow to flow through a filter before being discharged out of the vacuum cleaner. There are already many prior arts relating to the conversion of wind power into kinetic energy that are applied in vacuum cleaners, such as the vacuum cleaners disclosed in U.S. Pat. No. 6,101,667, U.S. Pat. No. 6,055,702, U.S. Pat. No. 6,023,814, U.S. Pat. No. 6,261,379, JP2006051171 and JP10057287. Generally, the power generated form an electric generator built inside the vacuum cleaner of the abovementioned disclosures is fed to the indicator lights and the dust sensors for supporting the same to operate. Moreover, the vacuum cleaners disclosed in the abovementioned disclosures can be divided into two categories. One of which are vacuum cleaners, disclosed in U.S. Pat. No. 6,261,379, JP2006051171 and JP1005728, which have impellers or electric generators being received inside their vacuum heads for enabling the induced airflow to be used directly for driving the impellers or the electric generators as soon as it is sucked into the vacuum cleaners from the vacuum heads. Nevertheless, although the applying of the airflow directly from the vacuum cleaner head upon the impeller or electric generator can be implemented directly and easily, the airflow directly from the vacuum cleaner head usually is saturated with dust and dirt, or even hairs and fibers that may easily cause the rotary elements in the impeller or electric generator to clog. As for the vacuum cleaners included in the other category, such as those disclosed in U.S. Pat. No. 6,101,667, U.S. Pat. No. 6,055,702, and U.S. Pat. No. 6,023,814, they generally designed with an additional inlet apart from the corresponding vacuum head to be used for housing the impellers or the electric generators therein, by which although the impellers or the electric generators can be prevented from being contaminated by the dust and dirt contained in the airflow from their vacuum heads, the impellers or the electric generators are still being exposed to the same airflow path inside the vacuum cleaners so that they can not be completely free from the contamination from the airflows of their vacuum heads. In addition, the wind power harvesters, such as the impellers and electric generators that are used in the aforementioned disclosures, are all being fixedly secured inside the vacuum cleaners, so that they can not be detached easily for maintenance.

TECHNICAL SUMMARY

The object of the present disclosure is to provide an auxiliary apparatus for vacuum cleaners, that not only is featured by its configuration of an independent second frame embedded with filters and an energy harvester in a manner that the filters in the second frame can prevent the energy harvester from being contaminated and thus clogged by dirt and dust while the energy harvester is operating for converting wind energy into electricity, but also is featured with its modularized design that the auxiliary apparatus can be easily detached from a vacuum cleaner as required.

To achieve the above object, the present disclosure provides an auxiliary apparatus for better vacuum cleaning effect, comprising:

a first frame, formed with a first entrance and a first exit in a manner that the first entrance is connected to the first exit by a channel;

a second frame, disposed at a side of the first frame while being formed with a second entrance and a second exit in a manner that the second entrance and the second exit are arranged at positions between the first entrance and the first exit and are connected to the channel of the first frame; and an energy harvester, for converting wind energy into electricity;

wherein, a main airflow being induced to enter the first frame through the first entrance is split into a first airflow and a second airflow while enabling the first airflow to flow toward the first exit and the second air to flow into the second frame through the second entrance so as to be guided toward the energy harvester for driving the same to generate electricity, and then the second airflow is guided to flow out of the second exit and enters the first frame where it is merged with the first airflow for flowing out of the first frame through the first exit.

Further scope of applicability of the present application will become more apparent from the detailed description given hereinafter. However, it should be understood that the detailed description and specific examples, while indicating exemplary embodiments of the disclosure, are given by way of illustration only, since various changes and modifications within the spirit and scope of the disclosure will become apparent to those skilled in the art from this detailed description.

BRIEF DESCRIPTION OF THE DRAWINGS

The present disclosure will become more fully understood from the detailed description given herein below and the accompanying drawings which are given by way of illustration only, and thus are not limitative of the present disclosure and wherein.

DESCRIPTION OF THE EXEMPLARY EMBODIMENTS

For your esteemed members of reviewing committee to further understand and recognize the fulfilled functions and structural characteristics of the disclosure, several exemplary embodiments cooperating with detailed description are presented as the follows.

Figure 1:
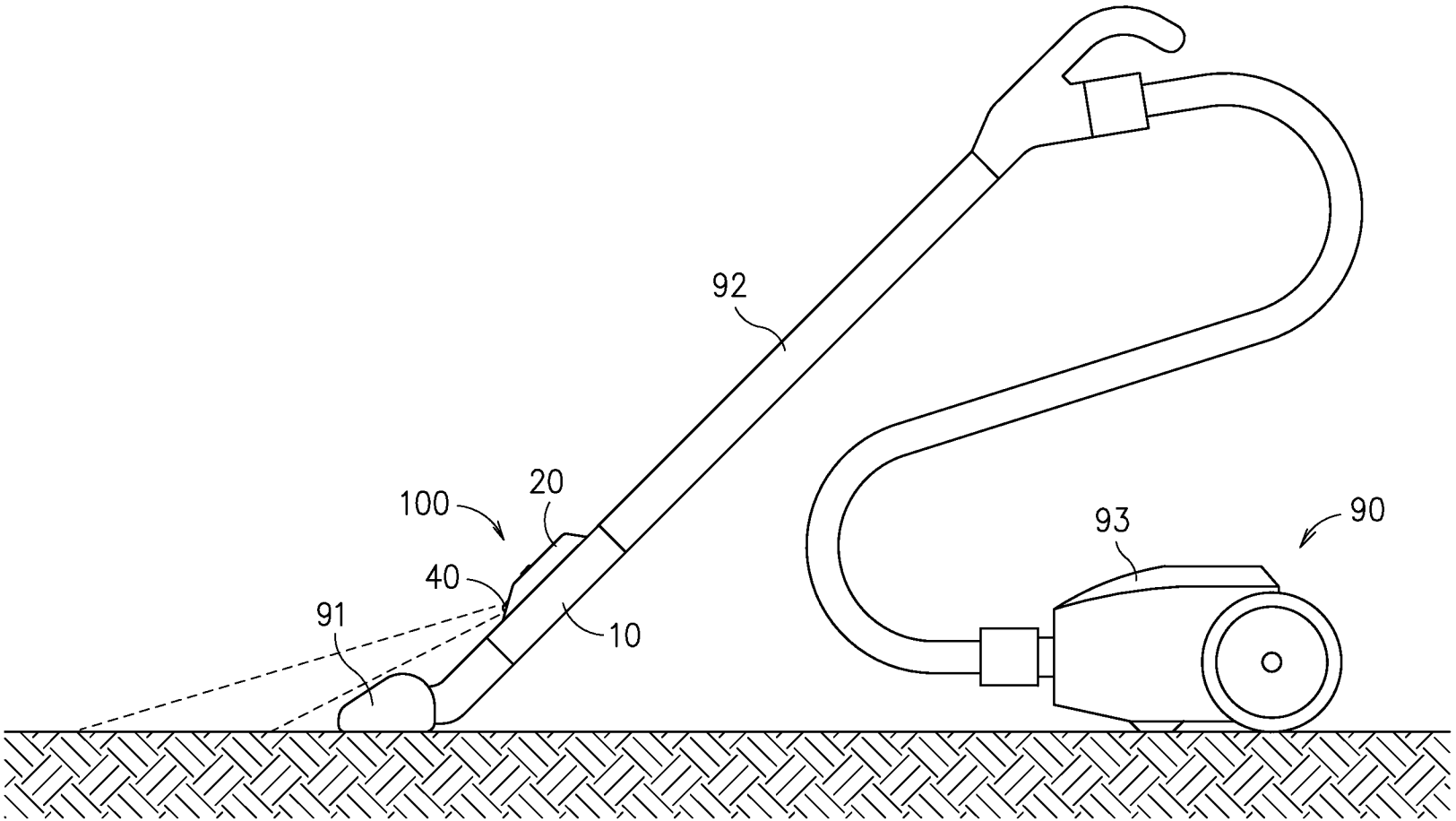
FIG. 1 is a schematic diagram showing an auxiliary apparatus of the present disclosure as it is fitted to a vacuum cleaner.
Figure 7:
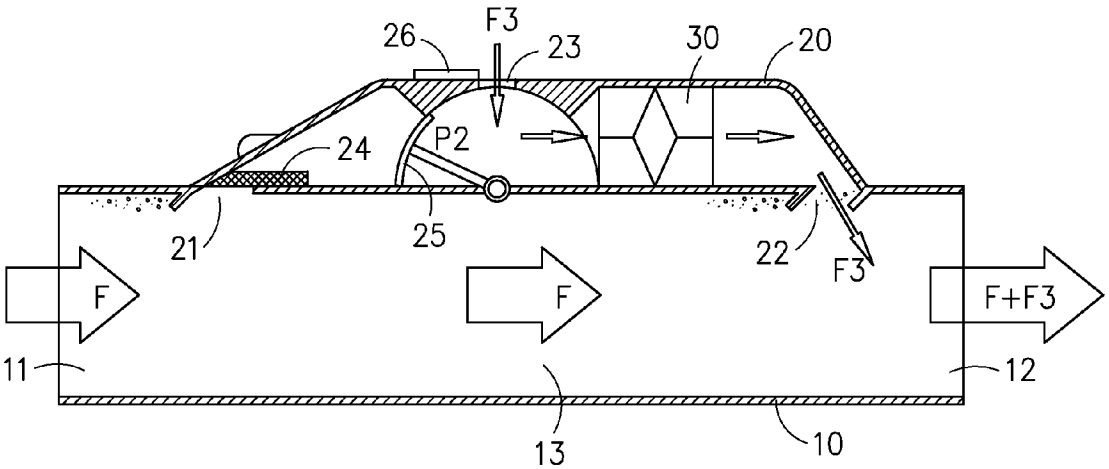
FIG. 7 and FIG. 8 are schematic diagrams showing two different airflow paths being enabled in an auxiliary apparatus of the present disclosure.

Please refer to FIG. 1, which is a schematic diagram showing an auxiliary apparatus of the present disclosure as it is fitted to a vacuum cleaner. As shown in FIG. 1, an auxiliary apparatus of the present disclosed can be assembled to a vacuum cleaner 90 at a position between the vacuum head 91 and its dust collecting tube 92, or can be sandwiched between and connected respectively to two dust collecting tubes of the vacuum cleaner 90, as shown in FIG. 7. When the vacuum cleaner 90 is activated, the motor received inside the mainframe 93 of the vacuum cleaner 90 is powered to operate at high speed and thus create a partial vacuum inside the main frame 93 to be used for inducing an airflow to suck up dust and dirt from its vacuum head 91 into the auxiliary apparatus 100, the dust collecting tube 92. Thereby, the dirt and dust are collected by either a dustbag inside the mainframe 93 for later disposal while the airflow is being discharged out of the mainframe 93.

Figure 2:
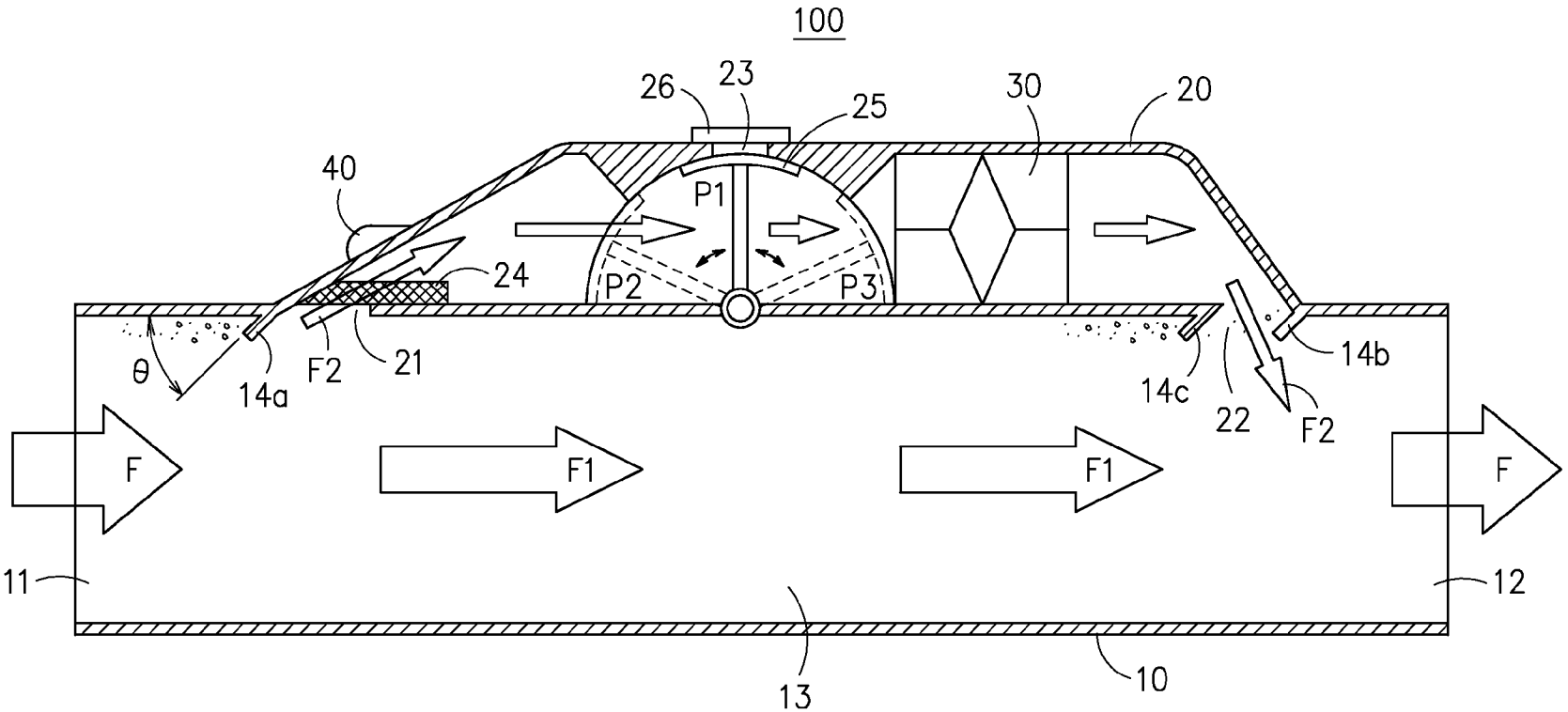
FIG. 2 is a sectional view of an auxiliary apparatus of the present disclosure.

As shown in FIG. 2, the auxiliary apparatus for better vacuuming effect of the present disclosure is composed of a first frame 10, a second frame 20 and an energy harvester 30, in which both of the first frame 10 and the second frame 20 are designed as independent spaces while allowing the second frame 20 to be disposed at a side of the first frame 10. Moreover, the airflows in the first and the second frames 10, 20 are induced to flow in different directions; and the energy harvester 30 is used for converting wind energy into electricity.

The first frame, 10 is formed with a first entrance 11 and a first exit 12 in a manner that the first entrance 11 is connected to the first exit 12 by a channel 13 while enabling the first entrance 11 to be connected to a vacuum head 91, that is further connected with a dust collecting tube 92, as shown in FIG. 1. In addition, the second frame 20 is formed with a second entrance 21 and a second exit 22 in a manner that the second entrance 21 and the second exit 22 are arranged at positions between the first entrance 11 and the first exit 12 and are connected to the channel 13 of the first frame 10. Moreover, there is a light-emitting device 40 being arranged on the outer sidewall of the second frame 20 that is electrically connected to the energy harvester 30 for enabling the same to be powered by the electricity from the energy harvester 30. In this embodiment, the light-emitting device 40 can be an LED or light bulb. In addition to the light-emitting device 40, the energy harvester 30 can be connected electrically to other devices including indicator lights or sensing devices for powering those devices to operate. It is noted that the first frame 10 can be integrally formed with the second frame 20, as shown in FIG. 2, or they can be manufactured independently and then are assembled into a one-piece kit, as shown in FIG. 2. In this embodiment, the first frame 10 has a plurality of block panels disposed therein, such as the three block panels 14*a*-14*c* shown in FIG. 2, that each of the plural block panels 14*a*-14*c* is arranged extending from the inner sidewall of the first frame 10 toward the first entrance 11 by a specific length while enabling an included angle θ to be formed between the referring block panel 14*a*-14*c* and the inner sidewall while enabling the included angle θ to be smaller than 90 degrees. Moreover, there is at least one of the plural block panels, i.e. the block panel 14*a* in this embodiment, being arranged at a side of the second entrance 21 that is proximate to the first entrance 11, and there are at least two of the plural block panels other than those arranged in the second entrance 21 i.e. the block panel 14*b* and 14*c* in this embodiment, that are arranged at the two opposite sides of the second exit 22 while allowing one of the two block panels, i.e. the block panel 14*b*, to be arranged at a side of the second exit 22 that is proximate to the first exit 12. It is noted that the arrangement of the plural block panels 14*a*~14*c* is designed to block the dust containing in the airflow for preventing the dust from entering the second frame 20 directly. In addition, the second frame 20 is formed with a hollow section 23 at a position between the second entrance 21 and the energy harvester 30 so as to be used for enabling the interior of the second frame 20 to communicate with its ambient environment. Furthermore, the second frame 20 further comprises a filter 24, which is disposed between the second entrance 21 and the energy harvester 30 at a position as close to the second entrance 21 as possible, so as to enable the second airflow F2 in the second frame 20 to flow passing the filter 24 for filtering out the dust containing therein before entering the energy harvester 30.

In addition, the second frame 20 further has a switch 25, whereas the switch 25 is further configured with a screen 26 that is capable of being selectively placed at a close position or an open position according to the switching of the switch 25, and in consequence, enabling the hollow section 23 to be closed or opened. Accordingly, the switch 25 is configured with a plurality of switching positions including a first switching position P1, a second switching position P2 and a third switching position P3. In FIG. 2, the switch 25 is enable to be positioned at the first switching position P1, by that the screen 26 is controlled to be placed at the closed position for closing the hollow section 23 while enabling the second entrance 21, i.e. the filter 24, to communicate with the energy harvester 30. Nevertheless, when the switch 25 is enable to be positioned at the second switching position P2, the hollow section 23 is opened while blocking the communication between the hollow section 23 and the second entrance 21, i.e. the filter 24, for enabling the hollow section 23 to communicate with the energy harvester 30; and when the switch is enable to be positioned at the third switching position P3, the hollow section 23 is opened while blocking the communication between the hollow section 23 and the energy harvester 30 for enabling the hollow section 23 to communicate with the second entrance 21, i.e. the filter 24. The controlling of the switch 25 for enabling the same to be positioned at different switch positions will be described further hereinafter, and the way for positioning the switch 25 at different switch positions can be achieved by the use of a rotary button disposed outside the second frame 20, or can be controlled by the use of an electronic device, that are known to those skilled in the art and thus will not be described further herein.

The energy harvester 30, being used for converting wind energy into electricity, is further composed of an electric generator and an energy harvesting unit, in that the energy harvesting unit is designed for harvesting wind energy of the second airflow to be used for driving the electric generator to generate electricity, as the embodiments shown in FIG. 3 to FIG. 6.

Figure 3:
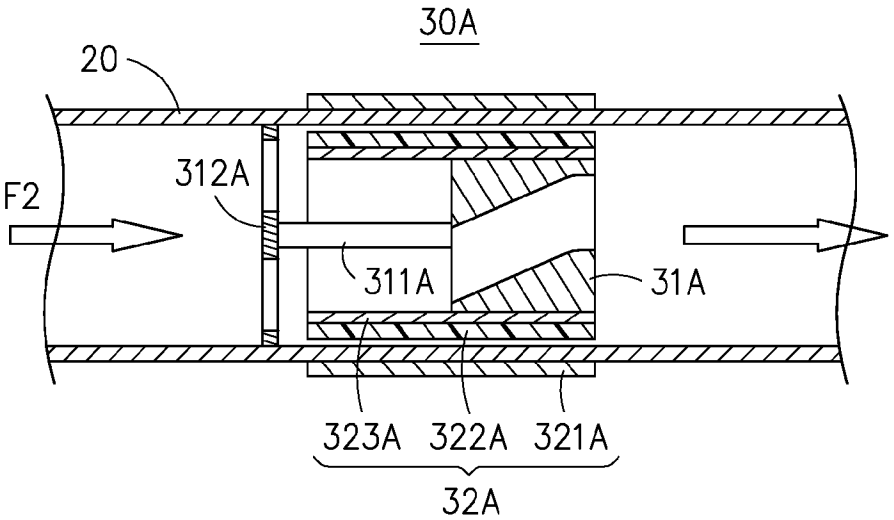
FIG. 3 to FIG. 6 are schematic diagrams showing different energy harvesters used in the auxiliary apparatus of the present disclosure

In the embodiment shown in FIG. 3, the energy harvester 30A is composed of an axial-flow impeller 31A and a coreless internal-rotation permanent-magnet electric generator 32A, in which the axial-flow impeller 31A is fixed to a rack 312A by a shaft 311A, and the coreless internal-rotation permanent-magnet electric generator 32A is comprised of: a coil 321A arranged outside the second frame 20; and a magnet 322A and a back iron 323A, both disposed inside the second frame 20. Accordingly, the axial-flow impeller 31A is used as an energy harvesting unit for harvesting wind energy of the second airflow F2 to be used for driving the coreless internal-rotation permanent-magnet electric generator 32A to rotate for generating electricity. Moreover, there can be a coupling device disposed between the axial-flow impeller 31A and the coreless internal-rotation permanent-magnet electric generator 32A, by that the coreless internal-rotation permanent-magnet electric generator 32A can be separated and isolated from the axial-flow impeller 31A so as to prevent the coreless internal-rotation permanent-magnet electric generator 32A from being contaminated by the dust in the second airflow F2.

Figure 4:
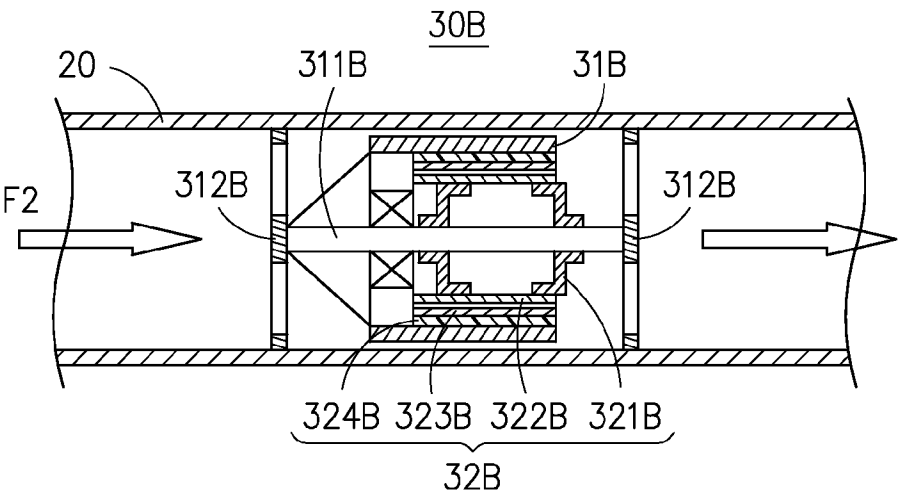

In the embodiment shown in FIG. 4, the energy harvester 30B is composed of an axial-flow impeller 31B and a coreless external-rotation permanent-magnet electric generator 32B, in which the axial-flow impeller 31B is fixed to a rack 312B by a shaft 311B, and the coreless external-rotation permanent-magnet electric generator 32B is comprised of: a supporting ring 321B, a coil 322*b*, a magnet 323B and a back iron 324B. Accordingly, the axial-flow impeller 31B is used as an energy harvesting unit for harvesting wind energy of the second airflow F2 to be used for driving the coreless external-rotation permanent-magnet electric generator 32B to rotate for generating electricity. Moreover, there can be a coupling device disposed between the axial-flow impeller 31B and the coreless external-rotation permanent-magnet electric generator 32B, by that the coreless external-rotation permanent-magnet electric generator 32B can be separated and isolated from the axial-flow impeller 31B so as to prevent the coreless internal-rotation permanent-magnet 32B from being contaminated by the dust in the second airflow F2.

Figure 5:
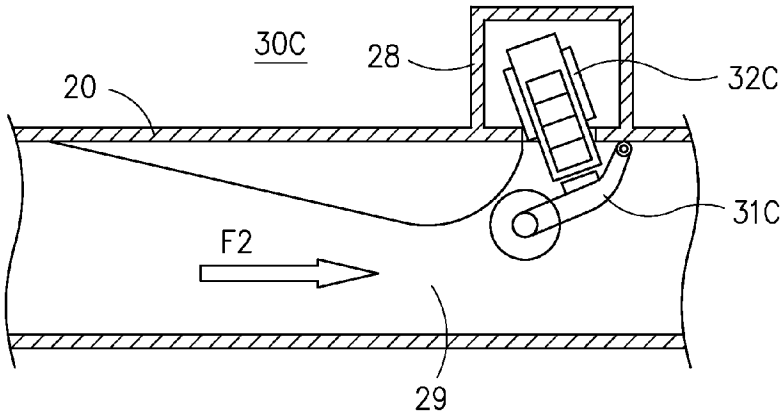

In the embodiment shown in FIG. 5, the energy harvester 30C is composed of: a light-weight oscillating rotor 31C, and an oscillating coreless linear permanent-magnet electric generator 32C, in which the light-weight oscillating rotor 31C is used as an energy harvesting unit for harvesting wind energy to be used for driving the oscillating coreless linear permanent-magnet electric generator 32C for generating electricity. It is noted that the oscillating coreless linear permanent-magnet electric generator 32C can be mounted inside a sub-shell 28 arranged outside the second frame 20.

Figure 6:
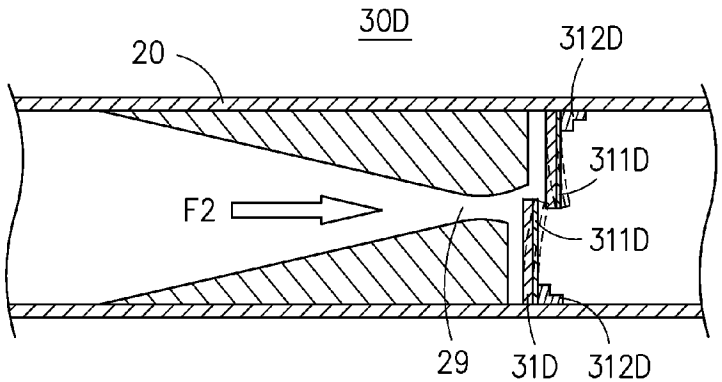

Moreover, in an energy harvester 30D shown in FIG. 6, a device of oscillating blades 31D is used as an energy harvesting unit for harvesting wind energy to be used for driving an oscillation piezoelectric generator to generate electricity. As shown in FIG. 6, the device of oscillating blades 31D is fixed to the inner sidewall of the second frame 20 by the use of a substrate 311D and a fixing seat 312D. It is note that the oscillating blade can be made of a PZT (lead zirconate titanate) film that can be deformed by oscillating, as the dotted lines shown in FIG. 6.

Similarly, there can be coupling devices being arranged respectively at positions between the light-weight oscillating rotor 31C and the oscillating coreless linear permanent-magnet electric generator 32C, as well as the device of oscillating blades 31D and the oscillation piezoelectric generator, by that the oscillating coreless linear permanent-magnet electric generator 32C and the oscillation piezoelectric generator can be separated and isolated from their corresponding light-weight oscillating rotor 31C and the device of oscillating blades 31D so as to prevent the oscillating coreless linear permanent-magnet electric generator 32C and the oscillation piezoelectric generator from being contaminated by the dust in the second airflow F2. Moreover, as shown in FIG. 5 and FIG. 6, the second frame 20 is formed with a channel 29 with tapering inner diameter while enabling the end of the channel with small inner diameter to be orientated toward the light-weight oscillating rotor 31C or the device of oscillating blades 31D, by that the flow speed of the second airflow F2 can be increased so as to improve the power generating efficiency of the corresponding electricity generator.

It is noted that all the aforesaid energy harvesters 30, 30A, 30B, 30C and 30D are disposed inside the second frame 20, by that the space inside the second frame 20 can be exploited completely while enabling the shell of the second frame 20 to be used as the shell of the energy harvesters 30, 30A, 30B, 30C and 30D at the same time. However, the energy harvester, such as those 30, 30A, 30B, 30C and 30D disclosed in the present disclosure, is not limited to be housed inside the second frame 20, it can be arranged in another space or shell that is independent from the second frame 20, but is capable of communicating with the second frame 20 and the second exit 22.

As shown in FIG. 1 and FIG. 2, when the vacuum cleaner 90 is activated, a main airflow F will induced from the vacuum head 91 to enter the first frame 10 through the first entrance 11 where it is split into a first airflow F1 and a second airflow F2 while enabling the first airflow F1 to flow toward the first exit 12 and the second airflow F2 to flow into the second frame 20 through the second entrance 21. Thereafter, at the time when the switch 25 is positioned at the first switching position P1 for allowing the second entrance 21, i.e. the filter 24, to communicate with the energy harvester 30, the second airflow F2 will be guided to flow passing through the filter 24 before entering the energy harvester 30, by that the dust containing in the second airflow F2 will be blocked first by the block panel 14*a* and then filtered by the filter 24, the second airflow F2 almost can be ensured to be dust-free when it is guided into the energy harvester 30 so that the energy harvester 30 can be prevented from being damaged by dust. As soon as the second airflow F2 flows through the energy harvester 30, the energy harvester 30 will be driven to generate electricity to be used for powering the light-emitting device 40 to illuminate. Thereafter, the second airflow F2 is guided to flow out of the second exit 22 and enters the first frame 10 where it is merged with the first airflow F1 for flowing out of the first frame 10 through the first exit 12, and then enters the dust collecting tube 92, as shown in FIG. 1.

In this embodiment, the caliber of the second entrance 21 is designed to be smaller than that of the first entrance 11, since the electricity generated from the energy harvester 30 is used primarily for powering the light-emitting device that is a low power device, and thus the flow rate of the second airflow F2 can be smaller than the flow rate of the first airflow F1. Thereby, the sucking power of the vacuum cleaner 90 will not be adversely affected. As shown in FIG. 1, the light emitted from the light-emitting device 40 can be very helpful regarding to the cleaning of areas that are lack of lighting, such as the area under a bed or sofa. It is noted that the light-emitting device 40 can be configured with an adjustable mechanism for adjusting its angle of projection, so that an user of the vacuum cleaner 90 is able to project a beam toward any location at will.

In FIG. 7, the switch 25 is positioned at the second switching position P2, by that the hollow section 23 is blocked from communicating with the second entrance 21, i.e. the filter 24, and the screen 26 is enabled to open by the control of the switch 25 for enabling the hollow section to open and thus capable of communicating with the energy harvester 30. Thereby, when the vacuum cleaner is activated, not only the main airflow F is induced to enter the first frame 10 through the first entrance 11, there will be another airflow F3 to be induced to flow into the second frame 20 through the hollow section 23, and then enter the energy harvester 30 for driving the same to generate electricity, that is, in addition to the main airflow F can be split and then provided for the energy harvester 30, there will be an additional clean airflow F3 provided for the energy harvester 30. Thereafter, the additional airflow F3 is similarly being guided to flow out of the second exit 22 and enters the first frame 10 where it is merged with the first airflow F1 for flowing out of the first frame 10 through the first exit 12.

Figure 8:
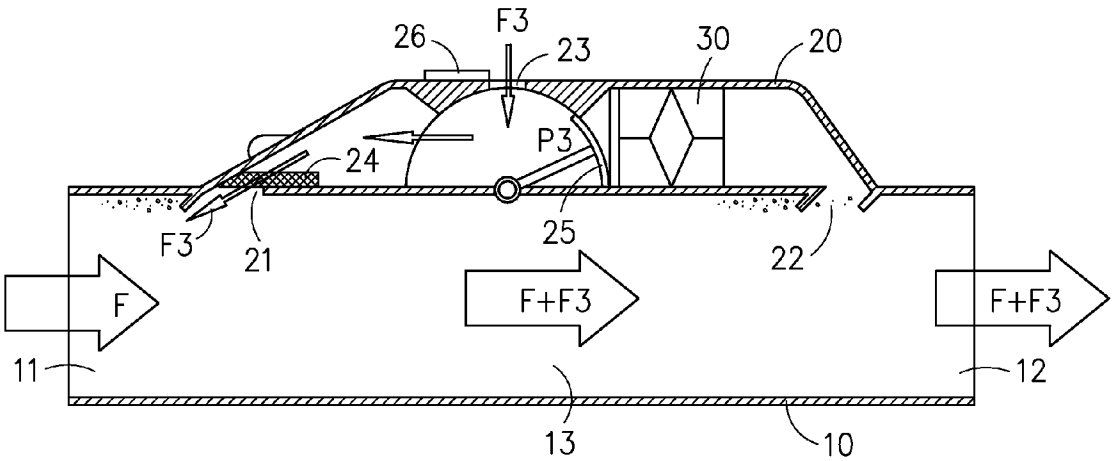

In FIG. 8, the switch 25 is positioned at the third switching position P3, by that the hollow section 23 is blocked from communicating with the energy harvester 30, and the screen 26 is enabled to open by the control of the switch 25 for enabling the hollow section to open and thus capable of communicating with the second entrance 21, i.e. the filter 24. Thereby, when the vacuum cleaner is activated, not only the main airflow F is induced to enter the first frame 10 through the first entrance 11, there will be another airflow F3 to be induced to flow into the second frame 20 through the hollow section 23, and then being guided to flow toward the filter 24 since the screen 26 is closed, by that the dust attached on the filter 24 can be blown off the filter 24, i.e. the filter is cleaned by the blowing of the airflow F3. Thereafter, the airflow F3 along with the dust from the filter 24 is guided to flow out of the second exit 22 and enters the first frame 10 where it is merged with the first airflow F1 for flowing out of the first frame 10 through the first exit 12. Consequently, the filter 24 is cleaned for preventing the same being clogged by excessive dust.

To sum up, the present disclosure provides an auxiliary apparatus for vacuum cleaners, that not only is featured by its configuration of an independent second frame embedded with filters and an energy harvester in a manner that the filters in the second frame can prevent the energy harvester from being contaminated and thus clogged by dirt and dust while the energy harvester is operating for converting wind energy into electricity, but also is featured with its modularized design that the auxiliary apparatus can be easily detached from a vacuum cleaner as required. Moreover, by the design for changing the path of the induced airflow according to the control of the switch, the functionality of the present disclosure is greatly improved. In an experiment, a common 600 W ~1800 W vacuum cleaner has a suction power of about 100 W ~300 W, and in a condition that the working wind rate is 2 CCM, suction power of 300 W, while assuming the power consumption of the second frame is lower than 10 W, the conversion efficiency of the energy harvester is ranged between 10~20%, the energy harvester is able to generate electricity between 1 W to 20 W, whereas the airflow being guided into the second frame is about 0.1 CMM. Since a common light-emitting device only require about 0.5 W to operate, the feasibility of the present disclosure is proven.

With respect to the above description then, it is to be realized that the optimum dimensional relationships for the parts of the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present disclosure.

What is claimed is:

1. An auxiliary apparatus for better vacuum cleaning effect, comprising:

a first frame, formed with a first entrance and a first exit in a manner that the first entrance is connected to the first exit by a channel;

a second frame, disposed at a side of the first frame while being formed with a second entrance and a second exit in a manner that the second entrance and the second exit are arranged at positions between the first entrance and the first exit and are connected to the channel of the first frame; and an energy harvester, for converting wind energy into electricity;

wherein the first frame, the second frame, and the energy harvester are constructed and arranged such that a main airflow being induced to enter the first frame through the first entrance is split into a first airflow and a second airflow while enabling the first airflow to flow toward the first exit and the second airflow to flow into the second frame through the second entrance so as to be guided toward the energy harvester for driving the same to generate electricity, and then the second airflow is guided to flow out of the second exit and enters the first frame where it is merged with the first airflow for flowing out of the first frame through the first exit.

2. The auxiliary apparatus of claim 1, wherein the second frame further comprises:

a filter, disposed at a position between the second entrance and the energy harvester for enabling the second airflow to flow passing the filter before entering the energy harvester.

3. The auxiliary apparatus of claim 1, wherein the first frame, the second frame, and the energy harvester are constructed and arranged such that the flow rate of the second airflow is smaller than that of the first airflow, and the first and the second airflows are induced to flow in different directions.

4. The auxiliary apparatus of claim 1, wherein the energy harvester further comprises:

an electric generator; and an energy harvesting unit, for harvesting wind energy of the second airflow to be used for driving the electric generator to generate electricity.

5. The auxiliary apparatus of claim 4, wherein the energy harvesting unit is an impeller, and the electric generator is a coreless rotary permanent-magnet electric generator.

6. The auxiliary apparatus of claim 5, wherein the impeller is a device selected from the group consisting of: an axial-flow impeller and a damper impeller.

7. The auxiliary apparatus of claim 4, wherein the energy harvester is a light-weight oscillating object, and the electric generator is an oscillating coreless linear permanent-magnet electric generator.

8. The auxiliary apparatus of claim 4, wherein the energy harvester is a device of oscillating blades, and the electric generator is an oscillation piezoelectric generator.

9. The auxiliary apparatus of claim 1, wherein the energy harvester is connected to at least one light emitting devices for enabling the same to be driven to emit light by the electricity generated from the energy harvester.

10. The auxiliary apparatus of claim 9, wherein the at least one light emitting device is arranged on the outer sidewall of the second frame.

11. The auxiliary apparatus of claim 1, wherein the second frame is formed with a hollow section at a position between the second entrance and the energy harvester so as to be used for enabling the interior of the second frame to communicate with its ambient environment.

12. The auxiliary apparatus of claim 11, wherein the second frame further has a switch received therein, the switch is configured with a plurality of switching positions including a first switching position, a second switching position and a third switching position, in a manner that the hollow section is closed for enabling the second entrance to communicate with the energy harvester when the switch is enable to be positioned at the first switching position, the hollow section is opened while blocking the communication between the hollow section and the second entrance for enabling the hollow section to communicate with the energy harvester when the switch is enable to be positioned at the second switching position, and the hollow section is opened while blocking the communication between the hollow section and the energy harvester for enabling the hollow section to communicate with the second entrance when the switch is enable to be positioned at the third switching position.

13. The auxiliary apparatus of claim 12, wherein the switch further comprises:

a screen, capable of being selectively placed at a close position or an open position according to the switching of the switch, and in consequence, enabling the hollow section to be closed or opened.

14. The auxiliary apparatus of claim 1, wherein the first frame has a plurality of block panels disposed therein in a manner that each of the plural block panels is arranged extending from the inner sidewall of the first frame toward the first entrance by a specific length while enabling an included angle to be formed between the referring block panel and the inner sidewall, and there is at least one of the plural block panels being arranged at a side of the second entrance that is proximate to the first entrance, and there are at least two of the plural block panels other than those arranged in the second entrance that are arranged at the two opposite sides of the second exit while allowing one of the two block panels to be arranged at a side of the second exit that is proximate to the first exit.

15. The auxiliary apparatus of claim 14, wherein the included angle is smaller than 90 degrees.

16. The auxiliary apparatus of claim 12, wherein when the switch is positioned at the third switching position, an external airflow is induced to flow toward the filter.

17. The auxiliary apparatus of claim 16, wherein the first frame, the second frame, and the energy harvester are constructed and arranged such that the external airflow blowing through the filter is capable of blowing off the dust attached to the filter.

18. The auxiliary apparatus of claim 17, wherein the first frame, the second frame, and the energy harvester are constructed and arranged such that the external airflow passing through the filter along with the dust from the filter is guided to flow out of the second frame through the second exit 22 and then enter the first frame.

19. The auxiliary apparatus of claim 18, wherein the external airflow entering the first frame is merged with the first airflow before being directed to flow out of the first frame through the first exit.

20. An auxiliary apparatus for better vacuum cleaning effect, comprising:

a first frame, formed with a first entrance and a first exit in a manner that the first entrance is connected to the first exit by a channel;

a second frame, disposed at a side of the first frame while being formed with a second entrance and a second exit in a manner that the second entrance and the second exit are arranged at positions between the first entrance and the first exit and are connected to the channel of the first frame; and an energy harvester, for converting wind energy into electricity;

wherein a main airflow being induced to enter the first frame through the first entrance is split into a first airflow and a second airflow while enabling the first airflow to flow toward the first exit and the second airflow to flow into the second frame through the second entrance so as to be guided toward the energy harvester for driving the same to generate electricity, and then the second airflow is guided to flow out of the second exit and enters the first frame where it is merged with the first airflow for flowing out of the first frame through the first exit and wherein the second frame is not disposed and received inside the first frame.

* * * * *